US010589536B2

(12) United States Patent
Nakakubo et al.

(10) Patent No.: US 10,589,536 B2
(45) Date of Patent: Mar. 17, 2020

(54) LIQUID EJECTING MODULE

(71) Applicant: CANON KABUSHIKI KAISHA, Tokyo (JP)

(72) Inventors: Toru Nakakubo, Kawasaki (JP); Takuro Yamazaki, Inagi (JP); Kazuhiro Yamada, Yokohama (JP); Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/379,360

(22) Filed: Apr. 9, 2019

(65) Prior Publication Data

US 2019/0232675 A1 Aug. 1, 2019

Related U.S. Application Data

(62) Division of application No. 15/995,493, filed on Jun. 1, 2018, now Pat. No. 10,300,707.

(30) Foreign Application Priority Data

Jun. 29, 2017 (JP) ..... 2017-127571

(51) Int. Cl.
*B41J 2/18* (2006.01)
*B41J 2/045* (2006.01)
(Continued)

(52) U.S. Cl.
CPC ..... *B41J 2/18* (2013.01); *B41J 2/0452* (2013.01); *B41J 2/04525* (2013.01);
(Continued)

(58) Field of Classification Search
CPC .... B41J 2/0452; B41J 2/04525; B41J 2/0453; B41J 2/04573; B41J 2/04581; B41J 2/14032; B41J 2/1414; B41J 2/18
See application file for complete search history.

(56) References Cited

U.S. PATENT DOCUMENTS 8,979,254 B2 3/2015 Ando et al.
9,254,658 B2 2/2016 Yamada et al.
(Continued)

FOREIGN PATENT DOCUMENTS

WO 2011/146069 A1 11/2011
WO 2011/146149 A1 11/2011
(Continued)

OTHER PUBLICATIONS

Extended European Search Report dated Nov. 2, 2018, in European Patent Application No. 18176449.9.
(Continued)

*Primary Examiner* — Lamson D Nguyen
(74) *Attorney, Agent, or Firm* — Venable LLP

(57) ABSTRACT

The present invention provides a liquid ejecting module capable of performing stable ejection operation while circulating and supplying fresh ink to the vicinity of ejection ports arranged in high density. To achieve this, a liquid ejecting module includes an element arranged face in which a plurality of ejecting elements are arranged, a circulation flow path including a supply flow path which supplies liquid to a pressure chamber and a collection flow path which collects liquid from the pressure chamber, and a liquid delivery mechanism provided in the circulation flow path for circulating liquid in the pressure chamber. The liquid delivery mechanism is located lower than the element arranged face.

20 Claims, 9 Drawing Sheets

(51) Int. Cl.

| | |
|---|---|
| ***B41J 2/155*** | (2006.01) |
| ***B41J 2/14*** | (2006.01) |
| ***B41J 2/175*** | (2006.01) |
| ***B41J 2/21*** | (2006.01) |

(52) U.S. Cl.

CPC ..... *B41J 2/04543* (2013.01); *B41J 2/04573* (2013.01); *B41J 2/04581* (2013.01); *B41J 2/14032* (2013.01); *B41J 2/14145* (2013.01); *B41J 2/14233* (2013.01); *B41J 2/155* (2013.01); *B41J 2/17596* (2013.01); *B41J 2/2103* (2013.01); *B41J 2002/14491* (2013.01); *B41J 2202/12* (2013.01); *B41J 2202/20* (2013.01)

(56) References Cited

U.S. PATENT DOCUMENTS

| | | | | |
|---|---|---|---|---|
| 9,452,606 | B2 | 9/2016 | Yamada | |
| 9,469,111 | B2 | 10/2016 | Yamada et al. | |
| 9,744,760 | B2 | 8/2017 | Yamada et al. | |
| 9,931,845 | B2 | 4/2018 | Moriya et al. | |
| 9,931,860 | B2 | 4/2018 | Tokimatsu et al. | |
| 10,300,707 | B2 * | 5/2019 | Nakakubo ..... | B41J 2/14233 |
| 2011/0228012 | A1 | 9/2011 | Yoshida et al. | |
| 2017/0197419 | A1 | 7/2017 | Okushima et al. | |
| 2017/0197439 | A1 | 7/2017 | Okushima et al. | |
| 2017/0274647 | A1 | 9/2017 | Aoki et al. | |
| 2017/0326875 | A1 | 11/2017 | Nakakubo et al. | |
| 2018/0170066 | A1 | 6/2018 | Ohtsu et al. | |
| 2019/0001671 | A1 | 1/2019 | Yamada et al. | |
| 2019/0001672 | A1 | 1/2019 | Hammura et al. | |
| 2019/0001692 | A1 | 1/2019 | Yamazaki et al. | |
| 2019/0001697 | A1 | 1/2019 | Yamada et al. | |
| 2019/0001698 | A1 | 1/2019 | Yamazaki et al. | |

FOREIGN PATENT DOCUMENTS

| | | | |
|---|---|---|---|
| WO | 2012/054017 | A1 | 4/2012 |
| WO | 2013/032471 | A1 | 3/2013 |
| WO | 2013/162606 | A1 | 10/2013 |
| WO | 2014/003772 | A1 | 1/2014 |
| WO | 2017/074324 | A1 | 5/2017 |

OTHER PUBLICATIONS

Office Action dated Jan. 16, 2020, in European Patent Application No. 18 176 449.9.

* cited by examiner

LIQUID EJECTING MODULE

BACKGROUND OF THE INVENTION

Field of the Invention

The present invention relates to a liquid ejecting module.

Description of the Related Art

In a liquid ejecting module such as an inkjet print head, there is a case where evaporation of a volatile component is developed from an ejection port that has not been operated for ejection for a while, thereby leading to a problem of degradation of ink (liquid). This is because the concentration of a component such as a color material increases due to the evaporation of the volatile component, and in a case where the color material is a pigment, coagulation and sedimentation of the pigment occurs so as to affect the state of ejection. To be more specific, there may be a case where dispersion in an ejecting amount and an ejecting direction and density unevenness and a stripe on an image are confirmed.

In order to suppress such degradation of ink, a method of constantly supplying fresh ink to an ejection port by circulating ink within a liquid ejecting module is proposed recently. International Publication No. WO2012/054017 discloses a configuration of circulating ink by an ink-bypass gap provided between a die including a nozzle and a die carrier that supplies ink to the die. International Publication No. WO2011/146149 discloses a configuration of arranging an element for generating energy for ejection, a pumping device, and an individual path flow for connecting the element and device for circulation on the same die face so as to prompt the circulation of ink within the flow paths that are connected to individual nozzles. International Publication No. WO2013/032471 discloses a configuration of placing an actuator at a position adjacent to an energy generating element for ejection to prompt ink circulation at a position very close to an ejection port.

SUMMARY OF THE INVENTION

According to an aspect of the present invention, there is provided a liquid ejecting module comprising: an element arranged face on which a plurality of ejecting elements are arranged, each of the ejecting elements including a pressure chamber in which liquid is contained, an energy generating element for applying energy to liquid in the pressure chamber, and an ejection port for ejecting liquid to which energy is applied by the energy generating element; a circulation flow path including a supply flow path which supplies liquid to the pressure chamber and a collection flow path which collects liquid from the pressure chamber; and a liquid delivery mechanism provided in the circulation flow path for circulating liquid in the pressure chamber, wherein, in a case where a direction of liquid to be ejected from the ejection port is assumed to be a direction from a lower side to an upper side, the liquid delivery mechanism is disposed lower than the element arranged face.

Further features of the present invention will become apparent from the following description of exemplary embodiments with reference to the attached drawings.

DESCRIPTION OF THE EMBODIMENTS

Figure 1:
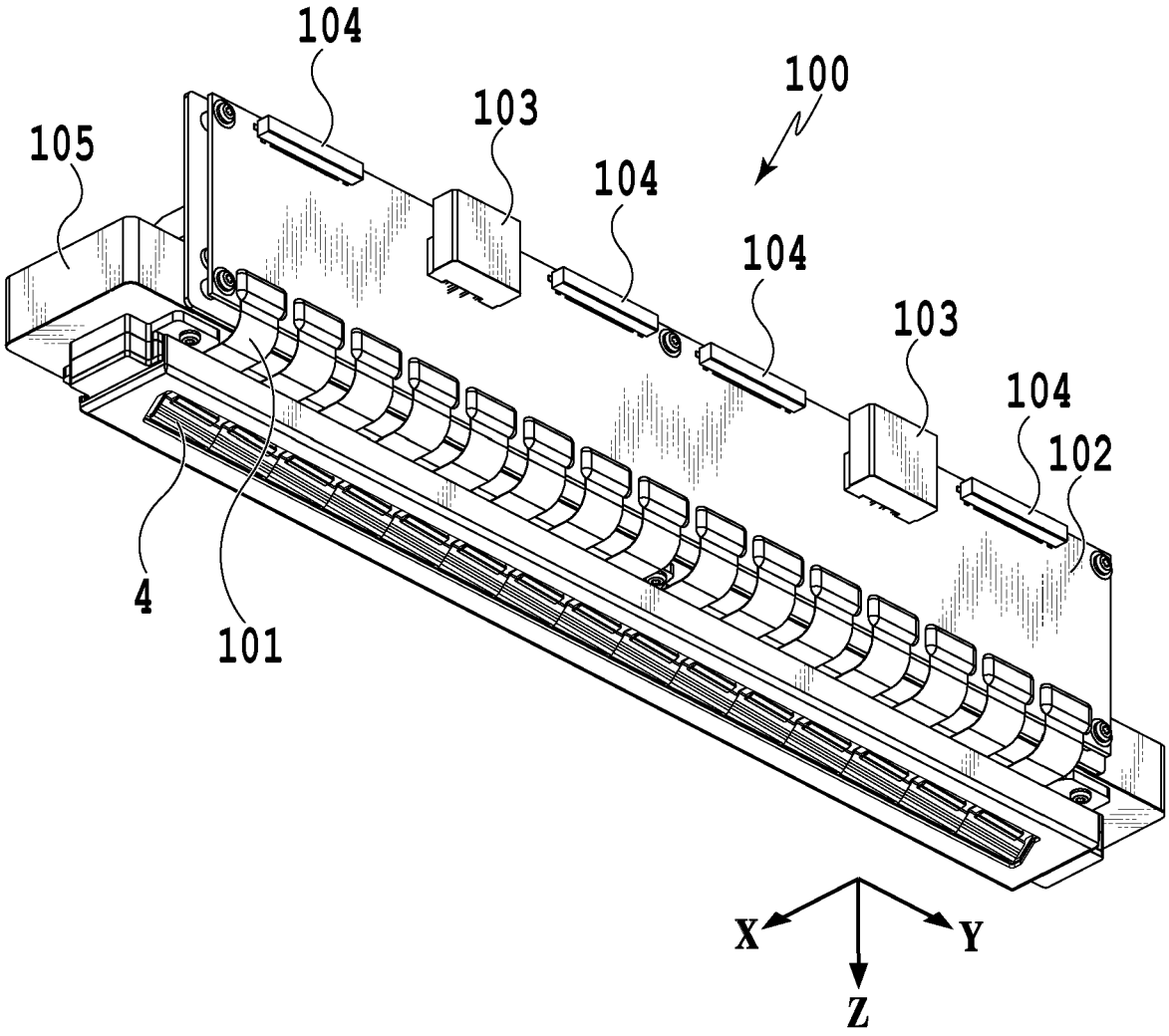
FIG. 1 is a perspective view of an inkjet print head.

However, in the configuration of International Publication No. WO2012/054017, a path through which ink actually circulates is apart from an ejection port, and accordingly, it is difficult to exert an effect of ink circulation to a tip end of the ejection port. For this reason, evaporation of ink located at the tip end of the ejection port progresses and thus an ink droplet to be initially ejected cannot necessarily be kept in a stable condition.

In the configuration of International Publication No. WO 2011/146149, ink in the vicinity of the ejection port can be circulated. However, since the energy generating elements, the pumps, and the circulation flow paths connecting therebetween are all arranged on the same die face on which the energy generating elements are disposed and the number of pumps and circulation flow paths correspond to the number of energy generating elements, the energy generating elements cannot be disposed in high density, thereby leading to a difficulty in achieving both high resolution and downsizing.

In contrast, in the configuration of International Publication No. WO2013/032471, ink in the vicinity of the ejection port can be circulated while achieving the ejection ports of a high density compared to the configuration of International Publication No. WO2011/146149. However, in the configuration of International Publication No. WO2013/032471, the actuator placed adjacent to the energy generating element makes a vertical movement so as to compress the flow path (pressure chamber), and thus a height of the pressure chamber needs to be larger than an amplitude of the actuator. As a result, energy efficiency for ejection operation in the energy generating element will be reduced. Particularly, since the actuator is arranged within the face on which the ejection port is formed, the thickness of a plate on which the ejection port is formed is restricted by formation of the actuator, thereby failing to make the ejection port thinner. Therefore, there may be a problem that pressure loss inside the ejection port becomes large and more energy is consumed upon ejection.

The present invention is made to resolve the above problems. Accordingly, an object of the present invention is to provide a liquid ejecting module capable of making stable ejection operation while circulating and supplying fresh ink to the vicinity of the ejection ports arranged in high density.

It should be noted that the liquid ejecting module constitutes a least a part of the configuration of the liquid ejection head. In an entire printer, in a case where a liquid ejection head and a system in which a sub-tank and a main tank are connected with the liquid ejection head via a supply tube or the like are provided, the supply tube, sub-tank, and main tank themselves are not included in the liquid ejecting module. Meanwhile, a part being called a chip which includes nozzles of the liquid ejection head, for example, corresponds to the liquid ejecting module. Further, a part separated from the printer independently for replacement also corresponds to the liquid ejecting module.

First Embodiment

FIG. 1 is a perspective view of an inkjet print head 100 (hereinafter simply referred to as a print head) which can be used as the liquid ejecting module of the present invention. The print head 100 has a plurality of printing element substrates 4, which are composed of a plurality of printing elements arranged in a Y direction, arranged in the Y direction. In this example, the print head 100 of a full-line type configured by arranging the printing element substrates 4 by a distance corresponding to the width of A4 size in the Y direction is shown.

The printing element substrates 4 are connected to a same electric wiring board 102 via respective flexible wiring substrates 101. On the electric wiring board 102, power supply terminals 103 for receiving power and signal input terminals 104 for receiving ejection signals are arranged. Meanwhile, on an ink supply unit 105, a circulation flow path for supplying ink supplied from a non-illustrated ink tank to the individual printing element substrates 4 and for collecting ink that has not been consumed in printing is formed.

In the above configuration, each of the printing elements arranged in the printing element substrates 4 uses, based on an ejection signal inputted from the signal input terminals 104, power supplied from the power supply terminals 103 and ejects ink supplied from the ink supply unit 105 in a Z direction in the figure.

Figure 2A:
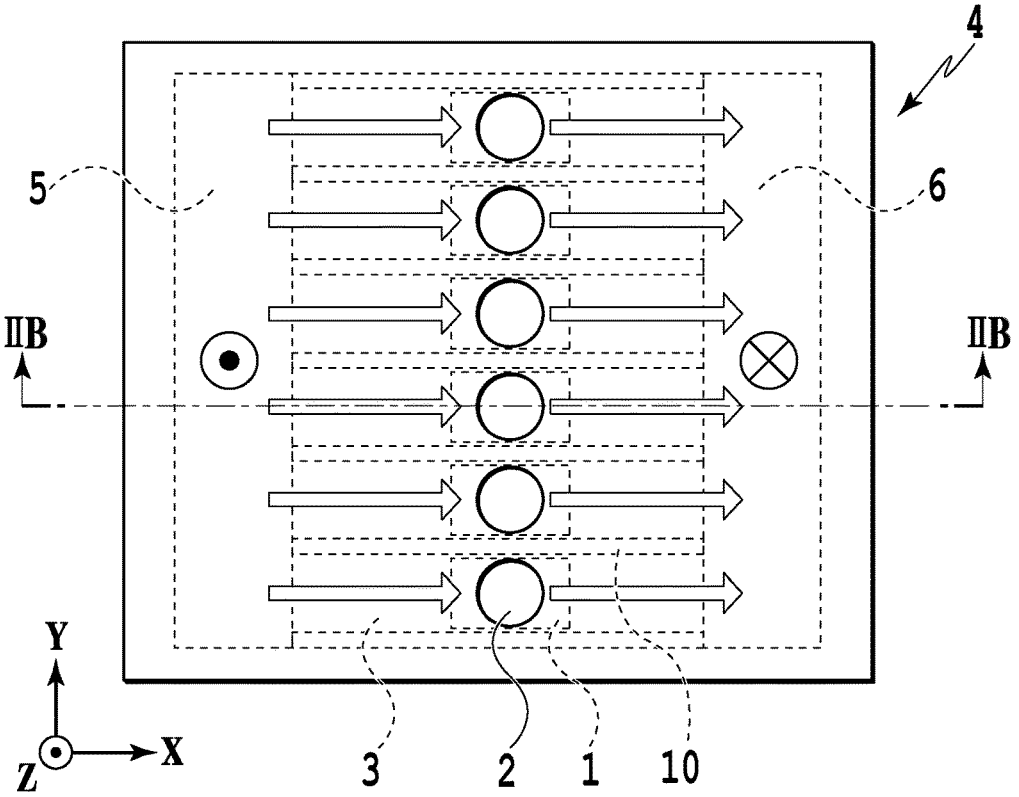
FIGS. 2A and 2B are configuration diagrams of flow paths in one block according to a first embodiment.
Figure 2B:
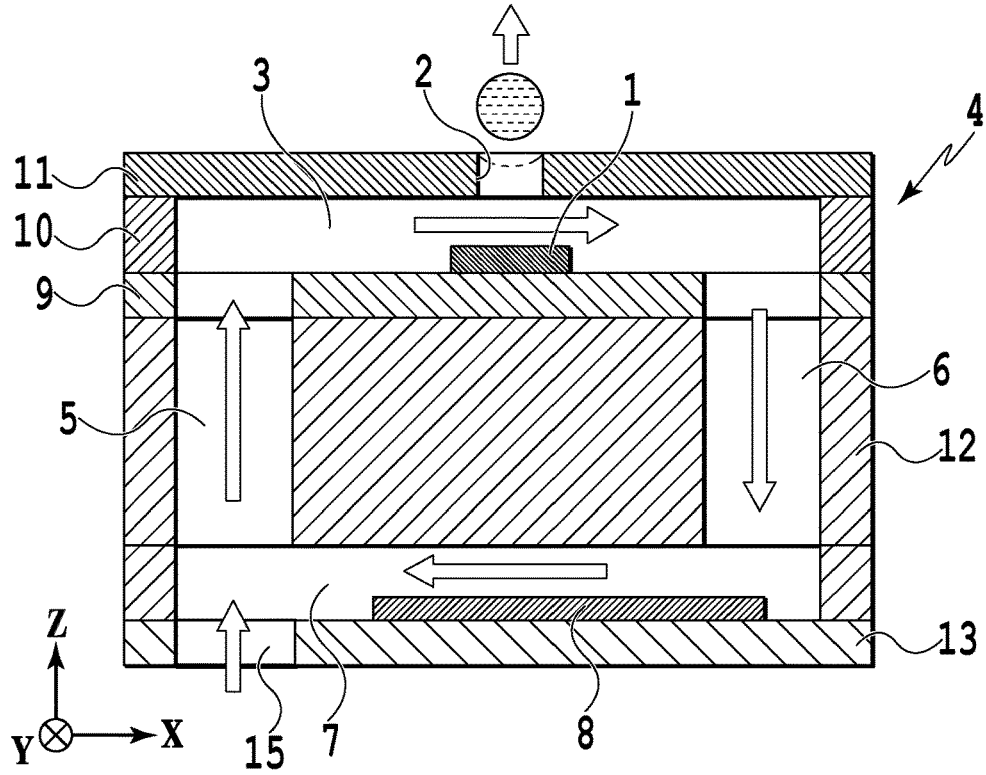

FIGS. 2A and 2B are diagrams showing the configuration of flow paths in one block. FIG. 2A is a perspective view of the printing element substrate 4 of the liquid ejecting module viewing from a side (+Z direction side) opposing the ejection port, and FIG. 2B is a cross-section view.

In the present embodiment, as shown in FIG. 2A, one block of flow paths includes a certain number of printing elements (six in this case) arranged adjacently in the Y direction and a common supply flow path 5 and a common collection flow path 6 which are shared by the printing elements. Ink supplied from the ink supply unit 105 circulates within the printing element substrate 4 through a circulation flow path prepared by each flow path block.

As shown in FIG. 2B, the printing element substrate 4 of the present embodiment is configured such that a second substrate 13, a first substrate 12, a function layer 9, a flow path forming member 10, and an ejection port forming member 11 are laminated in the named order in the Z direction. On the surface of the function layer 9, the energy generating element 1 which is an electrothermal transducing element is disposed. Further, on the ejection port forming member 11 at a position which corresponds to the energy generating element 1, an ejection port 2 is formed. Between a plurality of energy generating elements 1 arranged in the Y direction, the flow path forming member 10 interposed between the function layer 9 and the ejection port forming member 11 is arranged as a septum to form a pressure chamber 3 corresponding to the individual energy generating element 1 and ejection port 2. Below the pressure chamber 3, a connection flow path 7 connecting the supply flow path 5 and the collection flow path 6 by way of not passing through the pressure chamber 3 is provided.

Ink contained in the pressure chamber 3 forms meniscus at a position of the ejection port 2 in a stable state. If a voltage pulse is applied to the energy generating element 1 in accordance with an ejection signal, film boiling is generated in ink that contacts the energy generating element 1 and the ink is ejected as a droplet from the ejection port 2 in the Z direction due to the growing energy of generated bubbles. Assuming a direction in which liquid is ejected from the ejection port 2 (Z direction in this case) as a direction from a lower side to an upper side, ink is ejected from the lower side to the upper side. In actual ink ejection, ink may be ejected from an upper side to a lower side in the gravity direction, and in this case, the upper side of the gravity direction refers to the "lower side" and the lower side of the gravity direction refers to the "upper side" under the assumption. It should be noted that, in the present embodiment, a combination of the ejection port 2, the energy generating element 1, and the pressure chamber 3 is collectively referred to as the printing element (ejecting element).

As shown in FIG. 2B, in the printing element substrate 4 of the present embodiment, each of the second substrate 13, the first substrate 12, the function layer 9, the flow path forming member 10, and the ejection port forming member 11 is served as a wall to form the circulation flow path. The supply flow path 5 and the collection flow path 6 commonly supply and collect ink for the printing elements (a certain number of pressure chambers) within the block. On the surface of the second substrate 13 corresponding to the midstream of the connection flow path 7, a liquid delivery mechanism 8 is arranged. The liquid delivery mechanism 8 is located at a position facing a rear face of the face of the first substrate on which the energy generating element is formed to prompt ink circulation by making ink flow from the collection flow path 6 to the supply flow path 5. In other words, the circulation flow path including the supply flow path 5 and the collection flow path 6 is a flow path for circulating liquid between the inside of the pressure chamber 3 and the outside thereof.

In such a configuration, ink supplied from the ink supply unit 105 through a supply port 15 circulates within the printing element substrate 4 in the order of the supply flow path 5, the pressure chamber 3, the collection flow path 6, and the connection flow path 7. Once the ink in the pressure chamber 3 is consumed due to the ejection operation, fresh ink is supplied to the ejection port 2 to reform the meniscus. Even if the ejection operation is not performed, the above circulation is made to constantly supply fresh ink to the vicinity of the ejection port 2. Incidentally, although not shown in the figure, it is preferable that a filter for preventing intrusion of foreign matters and bubbles be provided in the supply flow path 5 before reaching the pressure chamber 3. As the filter, a columnar structure can be employed.

The printing element substrate 4 as described above can be fabricated by forming respective structures for the first substrate 12 and the second substrate 13 beforehand and then joining the first substrate 12 and the second substrate 13 together as shown in the figure. The connection flow path 7 can be formed by introducing an intermediate layer, having a groove, between the first substrate 12 and the second substrate 13 upon joining them, or alternatively, can be formed by performing etching on the rear face (−Z direction side) of the first substrate 12.

A specific example of dimensions of the above structures will be described below. In the print head 100, the printing elements, each including the energy generating element 1, the ejection port 2, and the pressure chamber 3, are arranged in the density of 600 npi (nozzle per inch) in the Y direction. The size of the energy generating element 1 is 20 μm×20 μm, the diameter of the ejection port 2 is 18 μm, the size of the pressure chamber 3 is 100 μm in an X direction×35 μm in the Y direction×5 μm in the Z direction. Further, the sectional shapes of the supply flow path 5 and the collection flow path 6 are 20 μm×40 μm, and the thickness of the ejection port forming member 11 is 5 μm. In addition, the viscosity of ink to be used is 2 cP and the amount of ink ejection from the individual ejection port is 2 pl.

Figure 3:
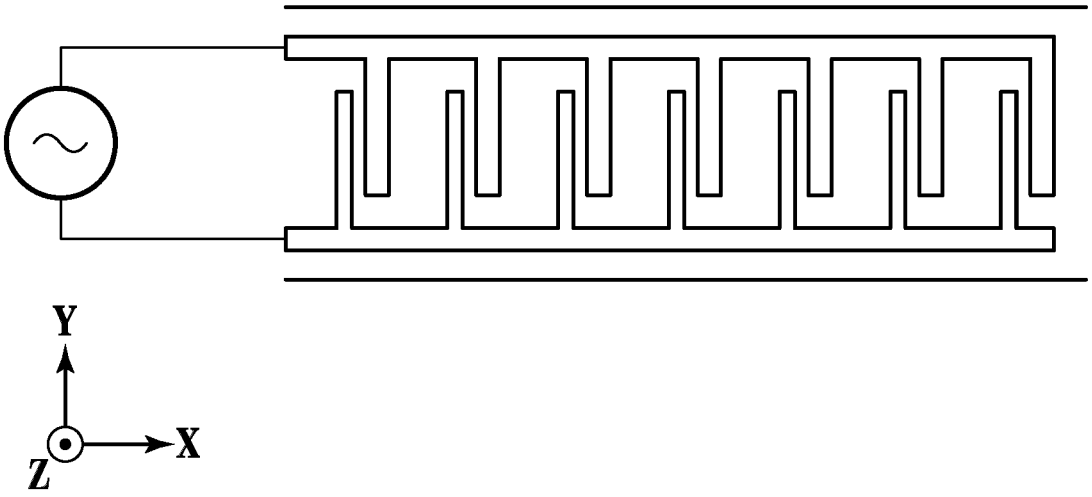
FIG. 3 is a plan view of an AC electro-osmotic (ACEO) pump.

Next, a specific example of the liquid delivery mechanism 8 that can be adopted by the present embodiment will be described below. FIG. 3 is a plan view of an AC electro-osmotic (ACEO) pump which can be adopted as the liquid delivery mechanism 8. A set of electrode groups having a comb-tooth shape have different widths and/or heights, and are arranged such that they mesh with each other. By applying an AC voltage between those electrodes, an asymmetrical electric field is generated in liquid located above so as to make the liquid flow in a desired direction.

For instance, the set of electrode groups include one group having a width of an electrode of 3 μm and the other group having a width of an electrode of 10 μm, and each electrode group has electrodes having an interval therebetween of 3 μm. Those electrode groups are arranged in the flow path having a width of 100 μm and a height of 20 μm. Then, the voltage of 5 to 30 V is applied in the cycle of 10 to 100 kHz. As a result, an appropriate ink flow can be generated to the overall circulation flow path including the connection flow path 7 without inviting electrolysis of ink.

Figure 4A:
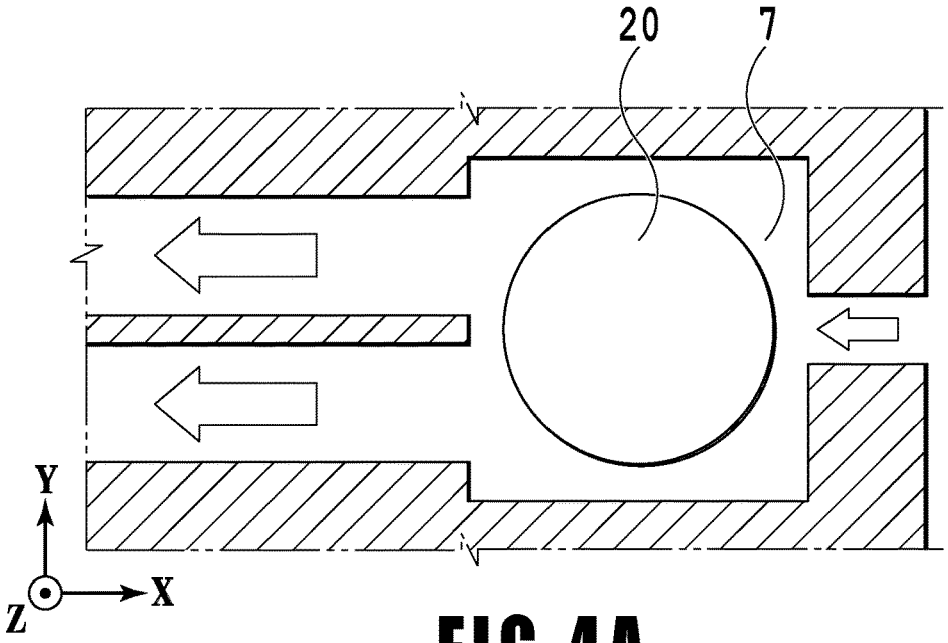
FIGS. 4A to 4C are diagrams showing a liquid delivery mechanism using an actuator.
Figure 4B:
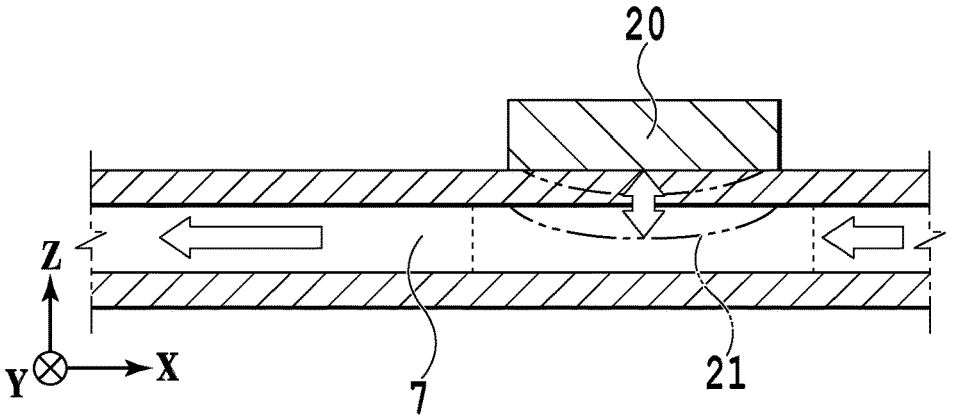
Figure 4C:
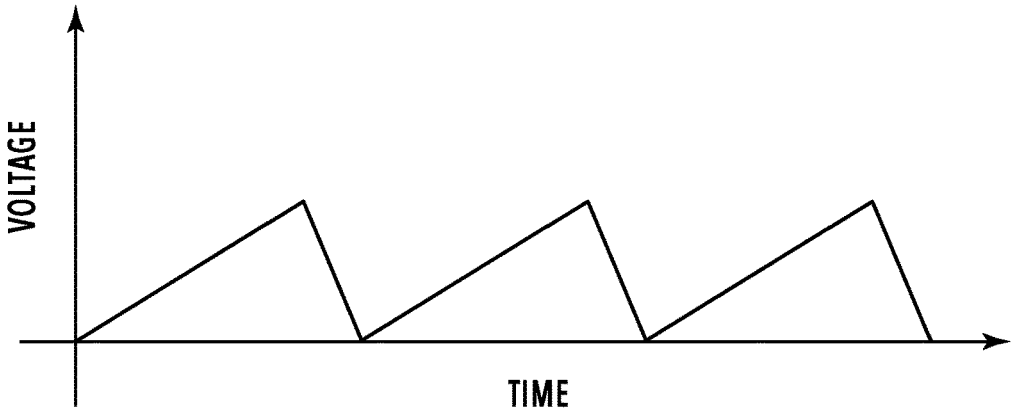

FIGS. 4A to 4C are diagrams showing a configuration in the case of using an actuator 20 as the liquid delivery mechanism 8. FIG. 4A is a top view of the connection flow path 7, and FIG. 4B shows a cross-section view. Due to the application of voltage, the actuator 20 displaces a diaphragm 21 which is exposed on the connection flow path 7 to change the volume of the flow path.

In the connection flow path 7 of the present example, the flow path of a downstream side (supply flow path 5 side) of the actuator 20 is set to have a higher flow path resistance and a lower inertance than those of the flow path of the upstream side (collection flow path 6 side). To be more specific, as shown in FIG. 4B, in the connection flow path 7 having the height of 20 μm in the Z direction, the diaphragm 21 made of Si or the like having a diameter of about 100 μm and a thickness of about 5 μm is arranged. Then, in the collection flow path 6 side of the actuator 20, a flow path having a width of 20 μm in the Y direction and a length of 20 μm in the X direction is prepared. In the supply flow path 5 side, two flow paths each having a width of 60 μm in the Y direction and a length of 200 μm in the X direction are prepared. In such a configuration, as shown in FIG. 4C, the voltage of about 50 V is periodically applied to generate ink flow in the connection flow path 7 from the collection flow path 6 side toward the supply flow path 5 side.

Figure 5A:
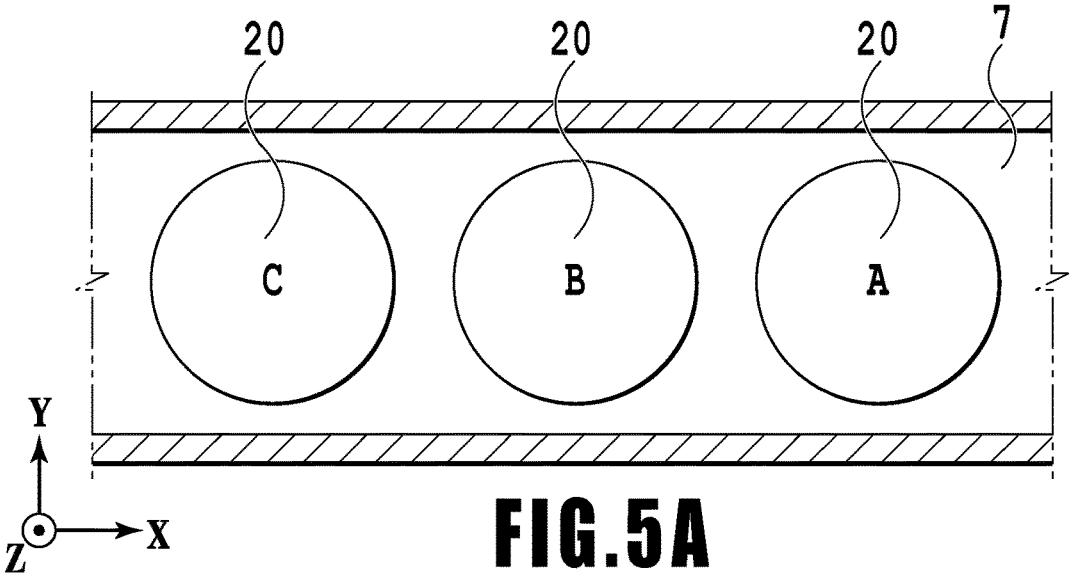
FIGS. 5A to 5C are diagrams showing the liquid delivery mechanism using a plurality of actuators.
Figure 5B:
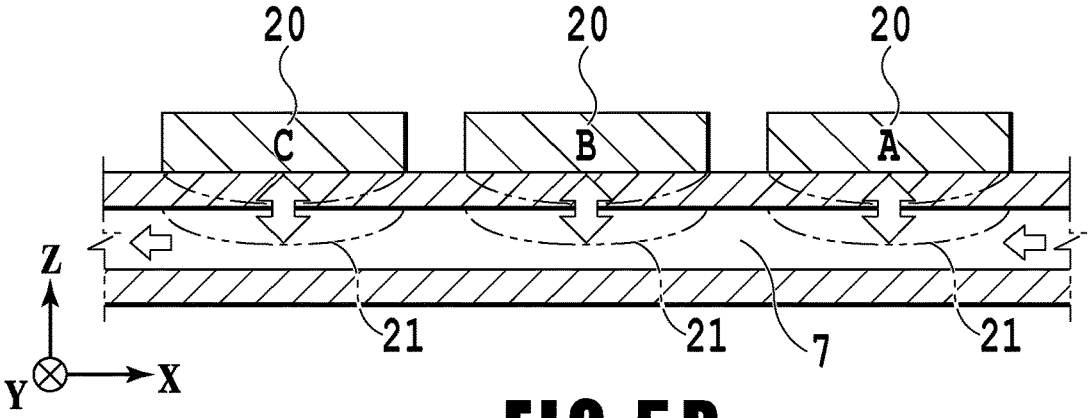
Figure 5C:
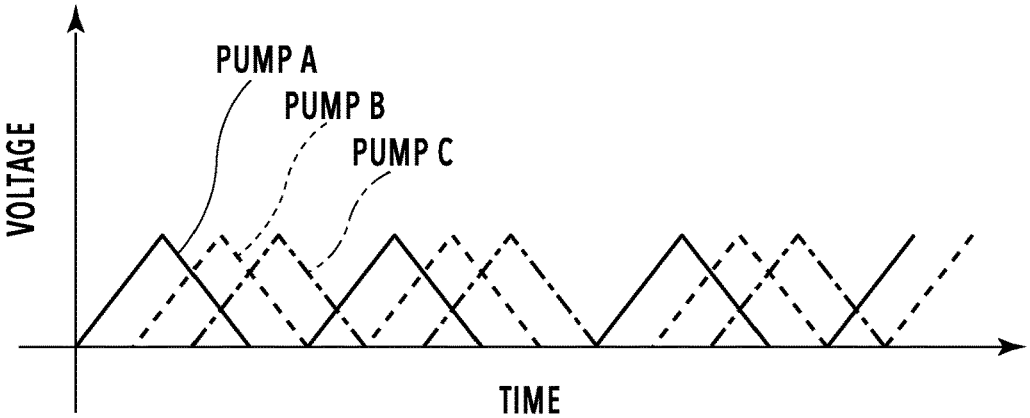

FIGS. 5A to 5C are diagrams showing a configuration in the case of using a plurality of actuators 20 as the liquid delivery mechanism 8. In the present example, the forms of the flow paths are uniform in the entire area of the connection flow path 7. To be more specific, a flow path having a width of about 120 μm in the Y direction and a height of about 20 μm in the Z direction extends in the X direction. Accordingly, the flow path resistances and the inertances are each equivalent across the entire area of the connection flow path 7.

Moreover, inside the connection flow path 7, three actuators 20 and three diaphragms 21 which are used in FIGS. 4A and 4B are arranged along the connection flow path 7. Further, as shown in FIG. 5C, the voltage of about 50 V is applied to the three actuators 20 in order. As a result, an ink flow is generated inside the connection flow path 7 from the collection flow path 6 side toward the supply flow path 5 side.

Figure 6A:
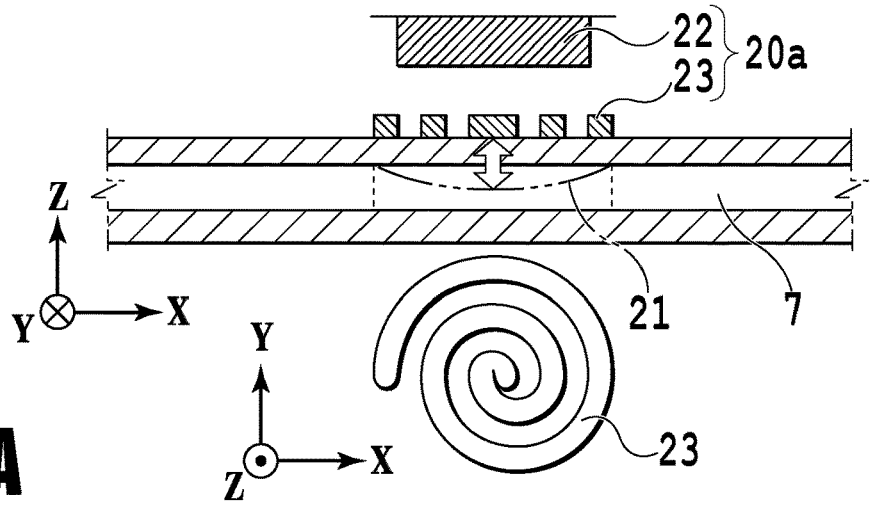
FIGS. 6A to 6D are diagrams showing examples of the actuators.

FIGS. 6A to 6D are diagrams showing examples of the actuators 20 used in FIGS. 4A to 4C and FIGS. 5A to 5C. FIG. 6A shows a cross-section view and a top view in the case of using an electromagnetic actuator 20*a* as the actuator 20. The electromagnetic actuator 20*a* is composed of a permanent magnet 22 and a coil 23, and has a mechanism such that repulsion is generated between the coil 23 and the permanent magnet 22 as a result of making a current flow through the coil 23, and the diaphragm 21 is consequently shifted.

The coil 23 can be finely formed on the face of the connection flow path 7 by a combination of photolithography and plating, for example. It should be noted that, even in a case of adopting a configuration of placing two coils facing each other instead of using the permanent magnet 22, it is possible to generate repulsion or a gravitational force between them to function as an actuator. Alternatively, a permanent magnet or coil can be used as one of facing elements for the electromagnetic actuator 20*a* and a magnetic substance such as Fe and Ni can be used as the other one of the elements so as to generate a gravitational force and to be dependent on rigidity of movable parts for resilience.

As for such an electromagnetic actuator 20*a*, the diaphragm 21 can be relatively largely displaced but large power is required to drive the electromagnetic actuator 20*a* itself.

Figure 6B:
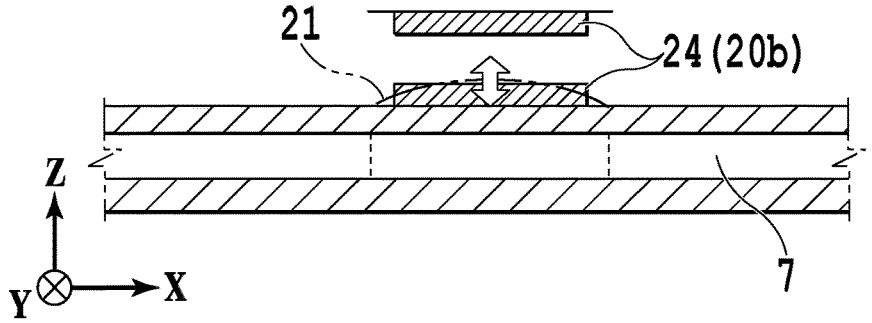

FIG. 6B is a cross-section view in the case of using an electrostatic actuator 20*b* as the actuator 20. The electrostatic actuator 20*b* is composed of two plate electrodes 24 facing each other. By applying voltage between the two plate electrodes 24, an electrostatic attraction force is generated between them to displace the diaphragm 21. The resilience is dependent on the rigidity of the movable parts. Such an electrostatic actuator 20*b* can be configured only by the two plate electrodes 24, and thus can be produced relatively simply at a low cost. However, in comparison with the electromagnetic actuator 20*a* shown in FIG. 6A, the displacement amount of the diaphragm 21 is small, and thus, there may be a case where enlarging the size of the plate electrodes 24 or increasing voltage for obtaining a desired displacement amount is required.

Figure 6C:
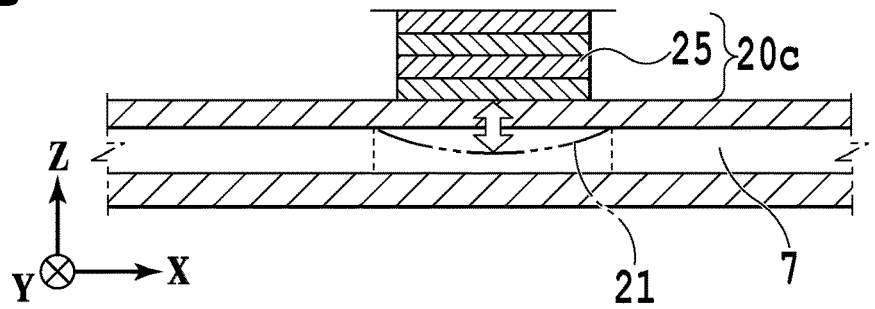

FIG. 6C is a cross-section view in the case of using a multilayer piezoelectric body 20*c* as the actuator 20. The multilayer piezoelectric body 20*c* is an actuator configured by laminating about ten piezoelectric sintered bodies 25 made of lead zirconate titanate (PZT) or the like together with electrodes. The multilayer piezoelectric body 20*c* is characterized to have a large drive force and can realize contractive movement of about several hundreds of nm by applying the voltage of about 20 V.

Figure 6D:
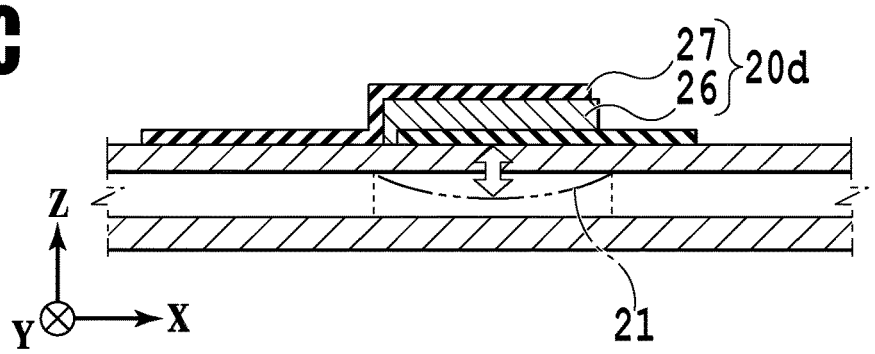

FIG. 6D is a cross-section view in the case of using a thin-film piezoelectric body 20*d* as the actuator 20. The thin-film piezoelectric body 20*d* has a structure of sandwiching a piezoelectric body 26 having a thickness of about 2 μm between electrodes 27. The piezoelectric body 26 has a PZT piezoelectric thin film. By applying voltage to the electrodes 27, warping by a bend mode is generated in the diaphragm 21. The piezoelectric body 26 can be film-formed by using a sol-gel method and sputtering, and can be patterned together with electrodes and the like using photolithography.

As the liquid delivery mechanism 8 of the present embodiment, any of the configurations shown in FIGS. 3 to 6D can be adopted alone or in combination. One large mechanism may be arranged, a plurality of small ones may be arranged, or ones having different types and sizes may be arranged. Alternatively, one liquid delivery mechanism 8 can correspond to six pressure chambers 3, similar to the supply flow path 5 and the collection flow path 6, so as to utilize areas occupied by the six pressure chambers 3. In this case, liquid delivering efficiency can further be enhanced due to increased variance such as decreasing flow path resistance or adjusting the size of the actuator 20, the number of actuators 20, and the displacement amount thereof.

In the printing element substrates 4 of the present embodiment as described above, a distance between the path in which ink is circulated and the ejection port 2 is not so large compared to the substrate disclosed in International Publication No. WO2012/054017. Accordingly, the effect of ink circulation can be exerted to the ejection port, and even at the use after a while, an ejection state of an ink droplet to be initially ejected can be stabilized. Further, in the printing element substrate 4 of the present embodiment, the face on which the liquid delivery mechanism 8 is arranged is provided in a manner deviated, in the Z direction, from the element-arranged face on which the plurality of printing elements are arranged, and their arranging areas overlap each other within an X-Y plane. In other words, if the direction of liquid to be ejected from the ejection port is assumed to be a direction from a lower side to an upper side, the liquid delivery mechanism 8 is disposed lower than the element-arranged face. In addition, in a case where the liquid ejecting module is viewed from a side opposing the ejection port, the liquid delivery mechanism 8 is arranged on an area that overlaps with the area in which the plurality of printing elements are arranged on the element-arranged face. For this reason, the density of positioning the printing elements is unlikely to be affected by the positioning of the liquid delivery mechanisms 8, thereby achieving high resolution and downsizing simultaneously. Further, it is possible to prevent the pressure chamber 3 from being blocked due to the displacement of the actuator as the substrate disclosed in International Publication No. WO 2013/032471, and therefore, the energy efficiency of the energy generating element 1 is unlikely to be reduced. In other words, according to the present embodiment, it is possible to stably maintain the ejection operation while circulating and supplying fresh ink to the vicinity of the ejection ports which are arranged in high density.

MODIFIED EXAMPLES

Figure 7A:
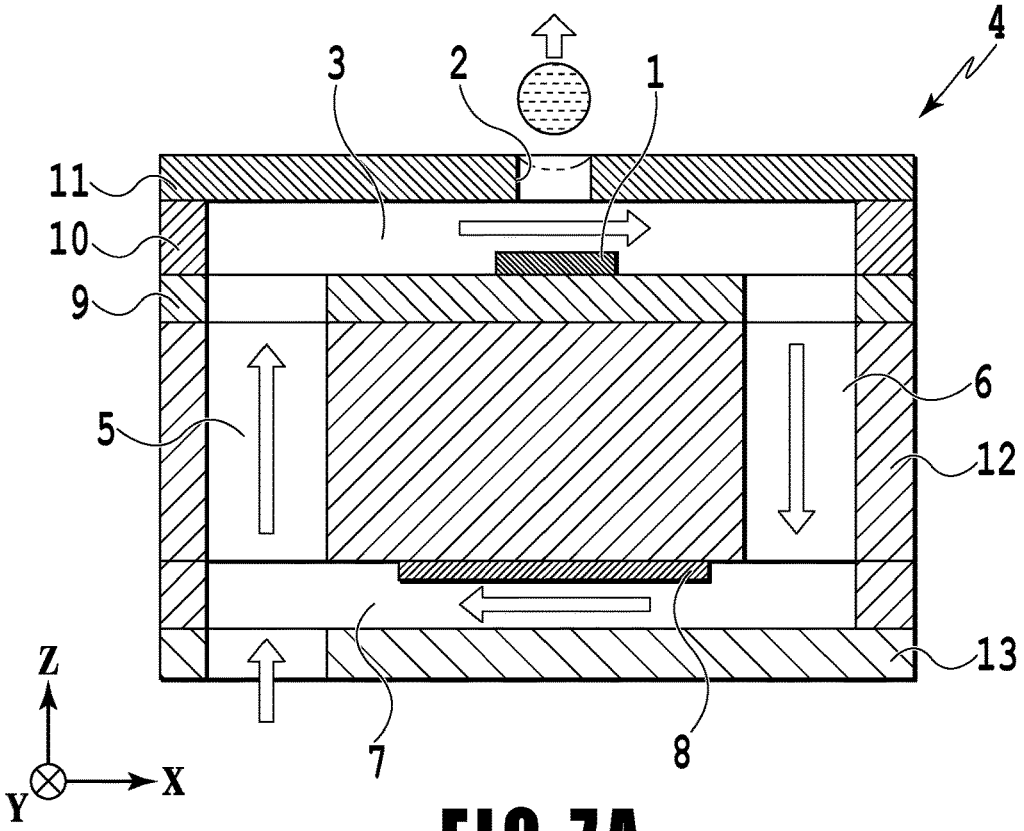
FIGS. 7A and 7B are diagrams showing modified examples of the first embodiment.
Figure 7B:
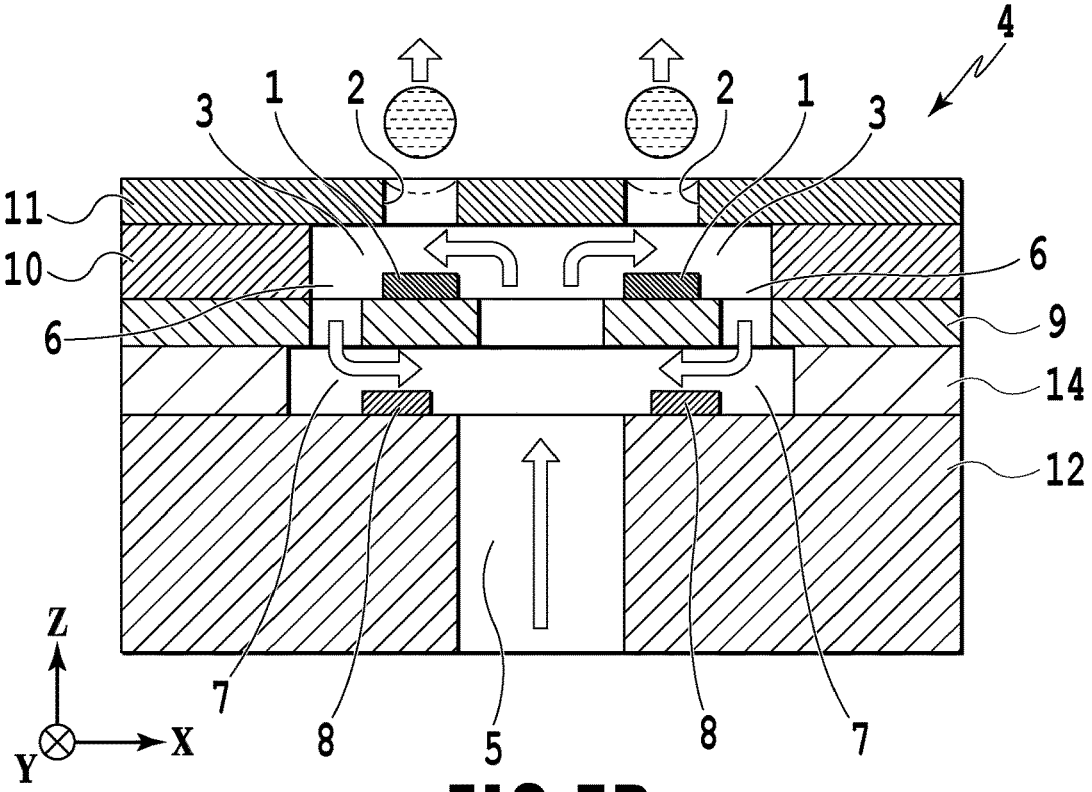

FIGS. 7A and 7B are diagrams showing modified examples of the first embodiment. FIG. 7A shows an example in which the liquid delivery mechanism 8 is arranged on the first substrate 12 side instead of on the second substrate 13. Even in such a configuration, ink flowing from the collection flow path 6 to the connection flow path 7 is conveyed in −X direction similar to FIG. 2B, and the same effect as that of the above embodiment can be obtained.

In the case of the configuration shown in FIG. 7A, since the energy generating element 1 is formed on the surface of the first substrate 12 and the liquid delivery mechanism 8 is formed at a rear face of the face (surface) on which the energy generating element 1 is formed, attention should be paid to a production process. For instance, in a case where a drive circuit of the energy generating element 1 is formed by using CMOS or the like and the thin-film piezoelectric body 26 shown in FIG. 6D is formed as the liquid delivery mechanism 8, the production process should be managed at a temperature no more than 450° C., which is a heat resistance temperature of CMOS parts. To be more specific, in order to reduce the film-forming temperature of the thin-film piezoelectric body 26, a method such as sputtering may be required to be adopted. On the other hand, in the case of the present configuration, there is an advantage that only one Si substrate is used for element arrangement.

FIG. 7B is a diagram showing a configuration in which the printing elements arranged in the Y direction are arrayed in two rows in the X direction. Between the first substrate 12 and the function layer 9, a second function layer 14 is interposed. At a space formed between the first substrate 12 and the function layer 9, the connection flow path 7 is provided. The supply flow path 5 is formed at a central position between the two printing element rows (ejecting element rows) so as to penetrate the first substrate 12. Ink flowing from the supply flow path 5 is branched into the right side and left side of the flow path forming member 10, passes through two pressure chambers 3 arranged on the both sides, flows through each of the collection flow paths 6 and each of the connection flow paths 7, and then merges at the supply flow path 5 again. The liquid delivery mechanisms 8 are provided on the first substrate 12 so as to be located in two connection flow paths 7, respectively. In this configuration as well, in the connection flow paths 7, a force directed toward the supply flow path 5 is applied to the flowing ink and thus the same effect as that of the above embodiment can be obtained. Also, in the present configuration, the liquid delivery mechanism 8 can be placed closer to the pressure chamber 3 compared to the configuration of FIG. 2B and FIG. 7A, and thus, the effect of circulation in the vicinity of the ejection port can be further increased.

In the case of the configuration shown in FIG. 7B, a logic circuit or the like which is connected to the energy generating elements 1 may be located on the second function layer 14 and only the energy generating elements 1 and wiring may be provided on the function layer 9. In this case, not only Si but also a resin may be used as the function layer 9.

In both of the modified examples shown in FIGS. 7A and 7B, each of the liquid delivery mechanisms 8 is provided in the connection flow path 7 located at a position deviated from the pressure chamber 3 in the Z direction (ejecting direction) and circulates ink within the pressure chamber 3. Consequently, it is possible to prevent ink in the vicinity of the ejection ports 2 from degradation and to stably maintain the ejection operation in the state in which the ejection ports are arranged in high density.

Second Embodiment

Figure 8A:
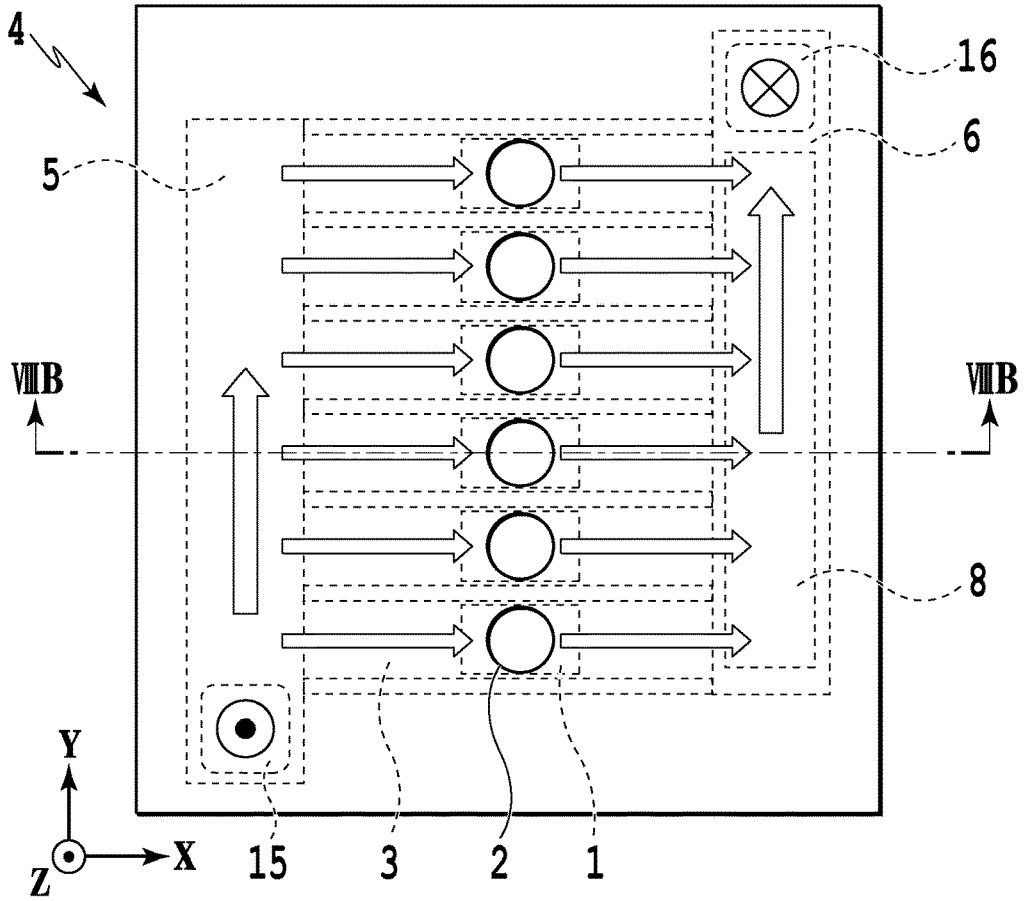
FIGS. 8A and 8B are configuration diagrams of flow paths in one block according to a second embodiment.
Figure 8B:
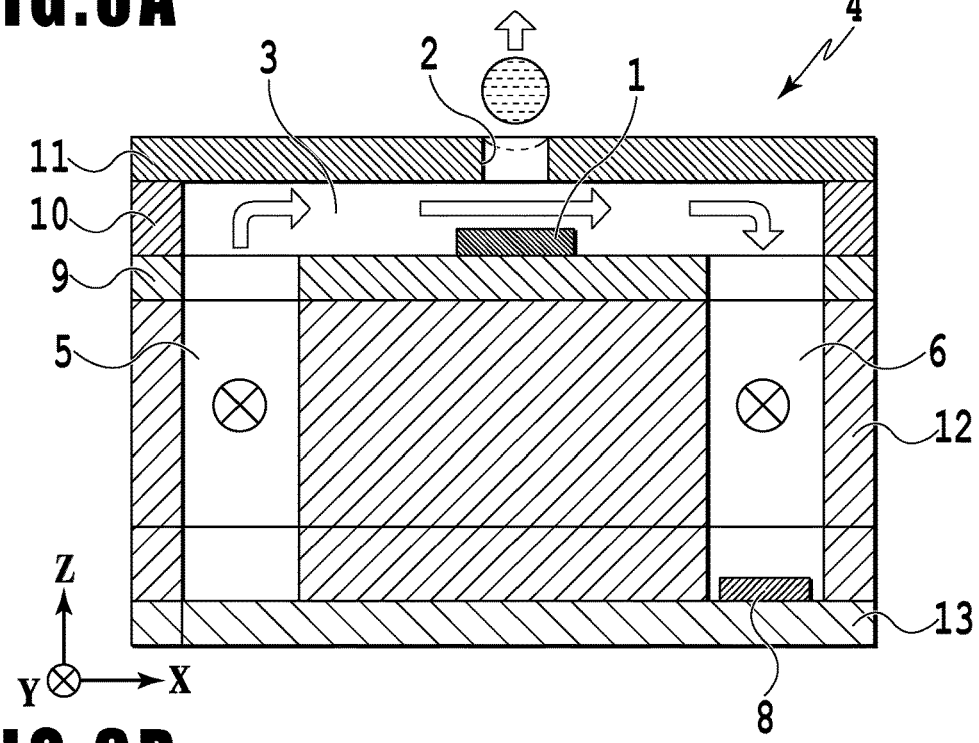

FIGS. 8A and 8B are diagrams showing a configuration of flow paths in one block, as in FIGS. 2A and 2B, according to the second embodiment. In the present embodiment as well, as in the first embodiment, the second substrate 13, the first substrate 12, the function layer 9, the flow path forming member 10, and the ejection port forming member 11 are laminated in the named order to form the circulation flow path. As to the configuration of the circulation flow path of the present embodiment, only a different aspect from that of the first embodiment will be described below.

In the printing element substrate 4 of the present embodiment, ink flowing into the supply flow path 5 from the supply port 15 moves in +Y direction, and branches and enters into each of the pressure chambers 3. Ink flowing out from each of the pressure chambers 3 merges into the collection flow path 6 in which ink flows in the same Y direction and moves on in +Y direction, and is discharged from a collection port 16 located at the end of the collection flow path to the ink supply unit 105. At the bottom of the collection flow path 6, the liquid delivery mechanism 8 extending in the Y direction is disposed to prompt the flow in +Y direction. It should be noted that the liquid delivery mechanism 8 may be disposed at the bottom of the supply flow path 5 or may be disposed at both the supply flow path 5 and the collection flow path 6.

As for the liquid delivery mechanism 8 of the present embodiment which is to be disposed on a relatively elongate flow path, a configuration of using the AC electro-osmotic (ACEO) pump shown in FIG. 3 or the plurality of actuators shown in FIGS. 5A to 5C is suitable. Particularly, the configuration using the plurality of actuators is effective in forming a progressive wave for commonly transporting a relatively large amount of ink flowed out from the plurality of pressure chambers as in the present embodiment.

The printing element substrate 4 of the present embodiment can be fabricated by joining together a member on the first substrate 12 side in which the supply flow path 5, the collection flow path 6, the pressure chamber 3, the energy generating element 1, and the ejection port 2 are formed and the second substrate 13 in which the liquid delivery mechanism 8, the supply port 15, and the collection port 16 are formed. At this time, the supply flow path 5 and the collection flow path 6 may be formed by etching the rear face of the first substrate 12, or may be formed by sandwiching the intermediate layer, having a groove, between the first substrate 12 and the second substrate 13.

According to the present embodiment described above, ink in the pressure chamber 3 is caused to flow and circulate by the liquid delivery mechanism 8 which is located in the supply flow path 5 or the collection flow path 6 at a position deviated from the pressure chamber 3 in the Z direction (ejecting direction). Consequently, it is possible to prevent ink in the vicinity of the ejection ports 2 from degradation and to stably maintain the ejection operation in the state in which the ejection ports are arranged in high density.

MODIFIED EXAMPLES

Figure 9A:
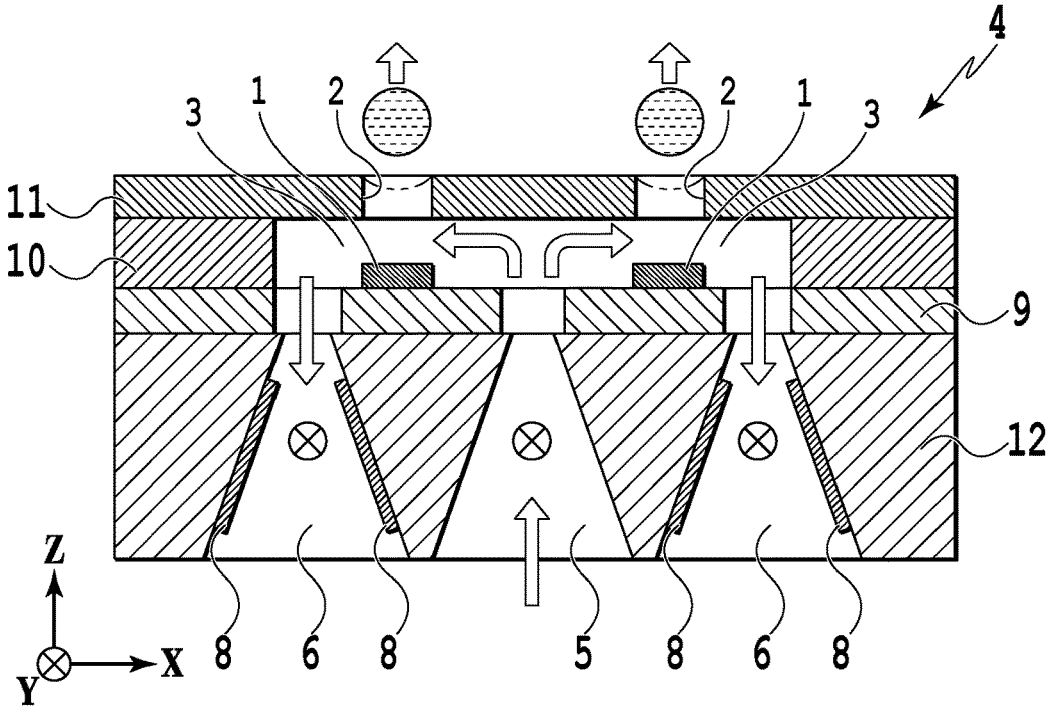
FIGS. 9A and 9B are diagrams showing modified examples of the second embodiment.
Figure 9B:
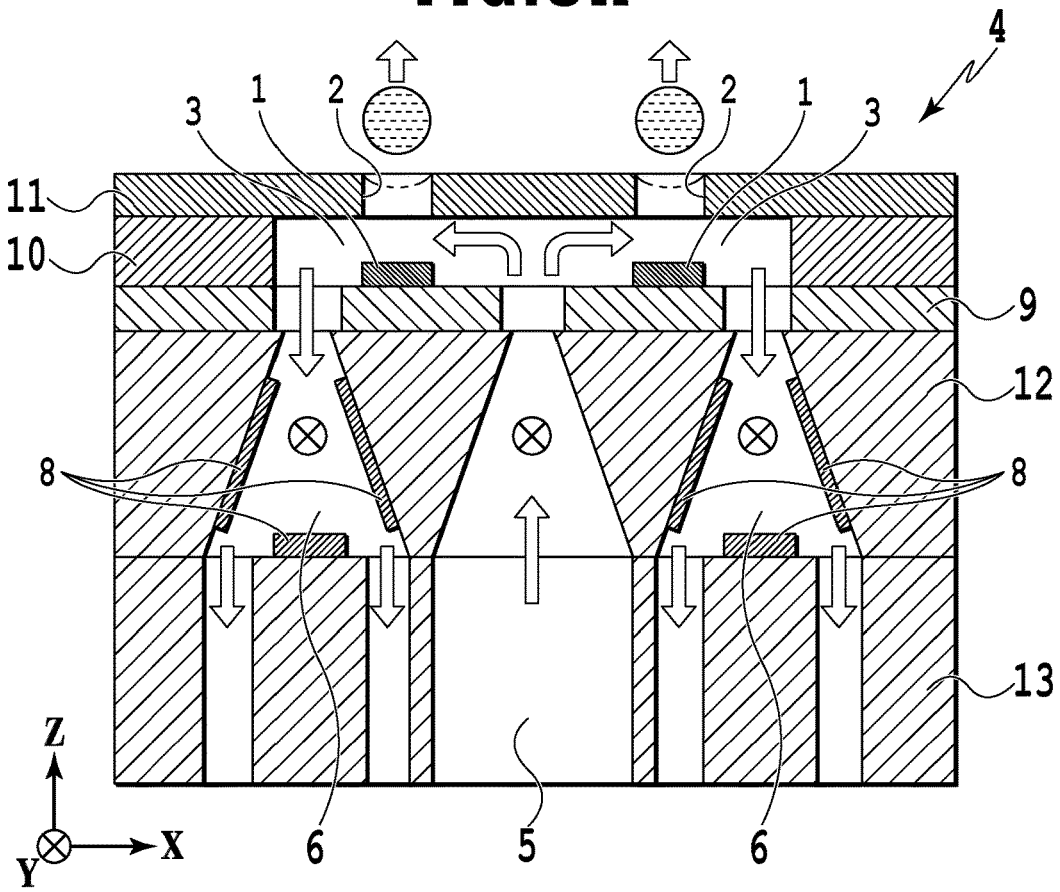

FIGS. 9A and 9B are diagrams showing modified examples of the second embodiment. Both examples show a configuration in which the printing elements arranged in the Y direction are arrayed in two rows in the X direction. The supply flow path 5 is formed in the central position between the two printing element rows so as to penetrate the first substrate 12 in the Z direction. The collection flow paths 6 are formed in positions at the outer sides of the two printing element rows so as to penetrate the first substrate 12 in the Z direction. Moreover, the supply flow path 5 as well as the collection flow paths 6 have the same tapered shape with its width expanding in −Z direction. Such a shape can be formed with the first substrate 12 made of <100> Si substrate by performing anisotropic wet etching using KOH solution or TMAH solution.

FIG. 9A shows, as to each of the two collection flow paths 6, a configuration in which the liquid delivery mechanisms 8 are disposed on the inner walls having inclinations. FIG. 9B shows, with respect to the configuration of FIG. 9A, a configuration such that a column is further provided in each of the collection flow paths 6 in the second substrate 13, in which a third liquid delivery mechanism 8 is disposed at the top end of the column. As for such liquid delivery mechanisms 8, the AC electro-osmotic (ACEO) pump shown in FIG. 3 is assumed to be suitable due to its relatively simple configuration. After forming the supply flow path 5 and the collection flow paths 6 of tapered shapes by performing the above-described anisotropic wet etching, the above pump can be implemented by coating a photoresist on the inner walls of the collection flow paths 6 by, for example, spray coater and by performing exposures with a projection exposing machine so as to form comb-tooth electrode patterns on the side walls. It should be noted that, in the present modified examples as well, the liquid delivery mechanisms 8 may be disposed at the bottom part of the supply flow path 5, or may be disposed in both the supply flow path 5 and the collection flow paths 6.

As described above, according to the present embodiment, the liquid delivery mechanisms 8 are provided on at least either one of the supply flow path 5 or the collection flow paths 6 to cause ink to be circulated in the order of the supply flow path 5, the pressure chamber 3, and the collection flow paths 6. Moreover, the liquid delivery mechanisms 8 are provided in the supply flow path 5 or the collection flow paths 6 which are located at positions deviated from the pressure chamber 3 in the Z direction (ejecting direction) so as to cause the ink in the pressure chamber 3 to be circulated. Consequently, it is possible to prevent ink in the vicinity of the ejection ports 2 from degradation and to stably maintain the ejection operation in the state in which the ejection ports are arranged in high density.

Other Embodiments

Incidentally, the above-described flow path structures and liquid delivery mechanisms are not limited to those of the embodiments and modified examples described above, but they may be combined in various ways. For instance, even in a form in which ink in the supply flow path 5 and ink in the collection flow path 6 flow in the Z direction which is identical to the ejecting direction as shown in FIG. 2A described in the first embodiment, the flow path structure shown in FIGS. 9A and 9B can be adopted. However, in this case, the liquid delivery mechanism 8 should be formed and driven so as to prompt the flow in the Y direction instead of in the Z direction.

Further, the six adjacent printing elements arrayed in the Y direction and their common supply flow path 5 and collection flow path 6 have been described above as one unit (flow path block) in the circulation flow path, but the present invention is not, of course, limited to such a form. The number of printing elements included in one block may be larger or smaller. For instance, a supply flow path and a collection flow path may be prepared for each of the printing elements, or a common supply flow path and collection flow path may be shared by all printing elements arranged on the printing element substrate.

In addition, an example of the printing element substrate having one row or two rows of the printing elements has been described above, but the present invention may be, of course, applied to the printing element substrate having three or more rows of the printing elements.

Further, the electrothermal transducing element has been used as the energy generating element 1 and the form in which ink is ejected as a result of the growing energy of generated bubbles caused by film boiling has been adopted, but the present invention is not limited to such an ejection method. For instance, various types of elements such as a piezoelectric actuator, an electrostatic actuator, a mechanical/impulse-driven actuator, a voice coil actuator, and a magnetostriction driven actuator may be adopted as an energy generating element.

Furthermore, an example of the print head of a full-line type in which the printing element substrates 4 are arranged by a distance corresponding to the width of a print medium has been described above with reference to FIG. 1, but the flow path configuration of the present invention may also be applied to a print head of a serial type. However, the elongate print head of a full-line type is more likely to be prominent in showing the problem to be solved by the present invention, that is, evaporation and degradation of ink, and thus can enjoy the effect of the present invention more prominently.

Moreover, an example of the print head that ejects ink containing a color material has been described above, but the liquid ejecting module of the present invention is not limited to this. For instance, it may be a module that ejects transparent liquid prepared for improving an image quality, or may be a module used for a purpose other than image printing such as a case of uniformly applying liquid of some kind to an object. In any case, as long as the liquid ejecting module ejects fine liquid droplets from a plurality of ejection ports, the present invention can function effectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional of U.S. patent application Ser. No. 15/995,493, filed Jun. 1, 2018, which claims the benefit of Japanese Patent Application No. 2017-127571 filed Jun. 29, 2017, which are hereby incorporated by reference herein in their entirety.

What is claimed is:

1. A print head of a full-line type in which a plurality of liquid ejecting modules are arranged along a distance corresponding to a width of a print medium, each of the liquid ejecting modules comprising:

an element arranged face on which a plurality of ejecting elements are arranged, each of the ejecting elements including:

a pressure chamber in which liquid is contained, an energy generating element for applying energy to liquid in the pressure chamber, and an ejection port for ejecting liquid to which energy is applied by the energy generating element;

a circulation flow path including a supply flow path which supplies liquid to the pressure chambers and a collection flow path which collects liquid from the pressure chambers; and a liquid delivery mechanism configured to circulate liquid between the inside of the pressure chambers and the outside thereof, wherein, in a case in which a direction of liquid to be ejected from the ejection ports is assumed to be a direction from a lower side to an upper side, the liquid delivery mechanism is disposed lower than the element arranged face, and the supply flow path supplies liquid by flowing the liquid from a lower position to a higher position and the collection flow path collects liquid by flowing the liquid from a higher position to a lower position.

2. The print head according to claim 1, wherein the liquid delivery mechanism is, in a case in which the liquid ejecting module is viewed from a side opposing the ejection ports, disposed at an area that overlaps with an area where the plurality of ejecting elements are arranged on the element arranged face.

3. The print head according to claim 1, wherein the circulation flow path further includes a connection flow path which connects the collection flow path and the supply flow path and does not include the pressure chambers, and the liquid delivery mechanism is provided in the connection flow path to make liquid flow from the collection flow path to the supply flow path.

4. The print head according to claim 3, wherein the liquid delivery mechanism is provided on a second substrate which differs from a first substrate on which the energy generating elements are formed at a position facing a rear face opposite to a face of the first substrate on which the energy generating elements are formed.

5. The print head according to claim 3, wherein the liquid delivery mechanism is provided on a first substrate on which the energy generating elements are formed at a rear face opposite to a face on which the energy generating elements are formed.

6. The print head according to claim 1, wherein the supply flow path commonly supplies liquid to a predetermined number of the pressure chambers and the collection flow path commonly collects liquid from the predetermined number of pressure chambers.

7. The print head according to claim 1, wherein the liquid delivery mechanism is provided at least at the collection flow path or the supply flow path so as to make liquid flow in a direction in which the pressure chambers are arranged.

8. The print head according to claim 1, wherein a plurality of ejecting element rows in which the ejecting elements are arrayed are arranged on the element arranged face, and the supply flow path is provided so as to commonly supply liquid to the plurality of ejecting element rows and the collection flow path is provided so as to collect liquid from each of the plurality of ejecting element rows.

9. The print head according to claim 1, wherein the liquid delivery mechanism is an AC electro-osmotic pump.

10. The print head according to claim 1, wherein the liquid delivery mechanism is comprised of an actuator and a diaphragm that changes a volume of the circulation flow path by using the actuator, and the circulation flow path has different flow path resistances and inertances for an upstream side and a downstream side of the liquid delivery mechanism.

11. The print head according to claim 1, wherein the liquid delivery mechanism is configured by arranging along the circulation flow path a plurality of actuators and diaphragms that change a volume of the circulation flow path by using the actuators, and the plurality of actuators are driven in order in a direction in which liquid flows in the circulation flow path.

12. The print head according to claim 1, comprising a plurality of substrates, each including the element arranged face, the circulation flow path, and the liquid delivery mechanism, the plurality of substrates being arranged in a direction in which the ejecting elements are arranged.

13. The print head according to claim 1, wherein the liquid is ink containing a color material.

14. The print head according to claim 1, wherein the energy generating elements are electro-thermal transducing elements.

15. The print head according to claim 1, wherein a plurality of the pressure chambers are provided corresponding to one liquid delivery mechanism.

16. The print head according to claim 1, wherein a plurality of the pressure chambers are provided corresponding to one supply flow path.

17. The print head according to claim 1, wherein a plurality of pressure chambers are provided corresponding to one collection flow path.

18. The print head according to claim 1, wherein the supply flow path has a tapered shape.

19. The print head according to claim 1, wherein the collection flow path has a tapered shape.

20. A liquid ejecting module comprising:

an element arranged face on which a plurality of ejecting elements are arranged, each of the ejecting elements including:

a pressure chamber in which liquid is contained, an energy generating element for applying energy to liquid in the pressure chamber, and an ejection port for ejecting liquid to which energy is applied by the energy generating element;

a circulation flow path including a supply flow path which supplies liquid to the pressure chambers and a collection flow path which collects liquid from the pressure chambers; and a liquid delivery mechanism configured to circulate liquid between the inside of the pressure chambers and the outside thereof, wherein, in a case in which a direction of liquid to be ejected from the ejection ports is assumed to be a direction from a lower side to an upper side, the liquid delivery mechanism is disposed lower than the element arranged face, and the supply flow path supplies liquid by flowing the liquid from a lower position to a higher position and the collection flow path collects liquid by flowing the liquid from a higher position to a lower position, the circulation flow path further includes a connection flow path which connects the collection flow path and the supply flow path and does not include the pressure chambers, the liquid delivery mechanism is provided in the connection flow path to make liquid flow from the collection flow path to the supply flow path, and the liquid delivery mechanism is provided on a substrate on which the energy generating elements are formed at a rear face opposite to a face on which the energy generating elements are formed.

* * * * *